United States Patent [19]

Krehbiel

[11] 4,125,851

[45] Nov. 14, 1978

[54] PHOTOGRAPHIC FILM PROCESSOR

[76] Inventor: Vivian D. Krehbiel, 715 E. 10th St., Wichita, Kans. 67214

[21] Appl. No.: 700,404

[22] Filed: Jun. 28, 1976

Related U.S. Application Data

[63] Continuation of Ser. No. 113,148, Feb. 8, 1971, abandoned.

[51] Int. Cl.[2] ..... G03D 3/08

[52] U.S. Cl. ..... 354/321; 29/120; 134/64 P

[58] Field of Search ..... 354/297, 317, 318, 319, 354/320, 321, 322; 134/64 P, 122 P; 29/120

[56] References Cited

U.S. PATENT DOCUMENTS

| | | | |
|---|---|---|---|
| 2,677,320 | 5/1954 | Coughlin | 354/297 |
| 2,913,974 | 11/1959 | Sabel et al. | 354/322 |
| 2,927,503 | 3/1960 | Zollinger | 354/321 X |
| 3,246,357 | 4/1966 | Ammons | 29/120 X |
| 3,336,853 | 8/1967 | Friedel | 354/321 X |
| 3,382,790 | 5/1968 | Matheson | 134/64 P |
| 3,463,073 | 8/1969 | Knibiehly | 134/122 P |
| 3,492,933 | 2/1970 | Knibiehly et al. | 134/122 P |
| 3,552,293 | 1/1971 | Cuthbert | 134/64 P |

FOREIGN PATENT DOCUMENTS 988,332 4/1965 United Kingdom.

*Primary Examiner*—Fred L. Braun
*Attorney, Agent, or Firm*—John H. Widdowson

[57] ABSTRACT

In a system for transporting photographic film through a series of processing tanks having a plurality of successive pairs of driven rollers. One of the rollers of each pair has a resilient stocking covering which scrubs the emulsion side of the film.

1 Claim, 3 Drawing Figures

INVENTOR.
VIVIAN D. KREHBIEL

BY Miller & Brown

ATTORNEY

PHOTOGRAPHIC FILM PROCESSOR

This is a continuation of application Ser. No. 113,148, filed Feb. 8, 1971, now abandoned.

BACKGROUND OF THE INVENTION

The present invention is directed to continuous processing methods of photographic film and more specifically to a positive drive transport system for automatically processing lengths and sheets of all types of film and paper.

It is a complex problem to transport a length of film, having a delicate emulsion layer, through the various stages of a developing process.

One of the primary problems experienced in continuous movement processors is bromide drag. Most of the prior art today transport the film by driven rollers held against each other by spring action. As the film passes through the rollers, a squeegee action takes place causing the bromide salts to build up behind the rollers, creating what is known in the trade as "bromide drag". Another serious problem with solid rollers is the build up of silver and other deposits on the rollers which must be removed and cleaned periodically. Solid rollers require a complex spring tensioning arrangement holding one roller against the other to maintain the close tolerances that are necessary.

Another prior art method utilizes solid rollers in combination with woven plastic belts. This system has a streaking problem on the film, due to the belt pressure, and includes a complex apparatus to handle the distortion and stretch of the belts.

SUMMARY OF THE INVENTION

In the present invention the problem of bromide drag is reduced with the use of the stocking covered roller. As the roller comes in contact with the film the bromide salts formed on the surface are entrapped between the fibers of the stocking and carried through on the roller rather than squeegeed behind the rollers. Before the roller again comes in contact with the film, it is exposed to a bath of fresh solution which washes these reacted chemicals from the stocking. The stocking is slightly depressed as the roller comes in contact with the film, causing the fibers of the stocking to mildly scrub the emulsion surface of the film, removing the exhausted chemicals, thereby better agitating the processing solution. When there is no film passing between the rollers, the stocking self-cleans itself by the continuous squeezing action against its companion roller in a circulating bath of clean solution. This squeezing action also scrubs any build up of silver off the companion roller.

Due to the resiliency of the stocking covering, the tolerance between the rollers is not critical, therefore avoiding the necessity of a spring tensioning one roller against the other.

It is therefore the principal object of the present invention to provide an improved film transport means that substantially reduces bromide drag, streaking and scratching of the film emulsion.

Another object of the invention is to provide a transport system having self-cleaning rollers which scrub against themselves when no film is in the processor.

A further object of the present invention is a roller transport system which provides more active agitation of the chemistry on the film thereby shortening the development time.

Still another object of the invention is to provide a roller type transport system without spring tensioning means on the rollers while maintaining even pressure across the rollers.

A further object of the invention is to provide a film roller which will wash itself in a slow moving solution of the exhausted chemicals collected from the film.

Further objects and advantages of the invention will be in part apparent and in part pointed out specifically hereinafter in connection with the description of the drawings that follows and in which.

Figure 3:
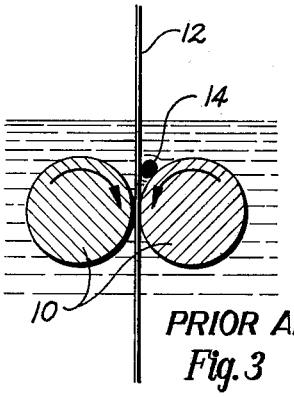
PRIOR ART Fig. 3
FIG. 3 is an illustration of the prior art.

Referring to the drawings for a detailed description of the invention and more specifically to FIG. 3, a typical pair of prior art rollers 10 are shown transporting a film strip 12 in a chemical solution. As these smooth surfaced rollers drive the film therebetween, a squeegee action takes place on the film causing the exhausted chemicals on the emulsion side of the film to build up in a bead 14.

This build up is particularly bad when the film moves in a vertical direction since the exhausted chemicals or bromide salts are heavier than the developing solution.

Figure 1:
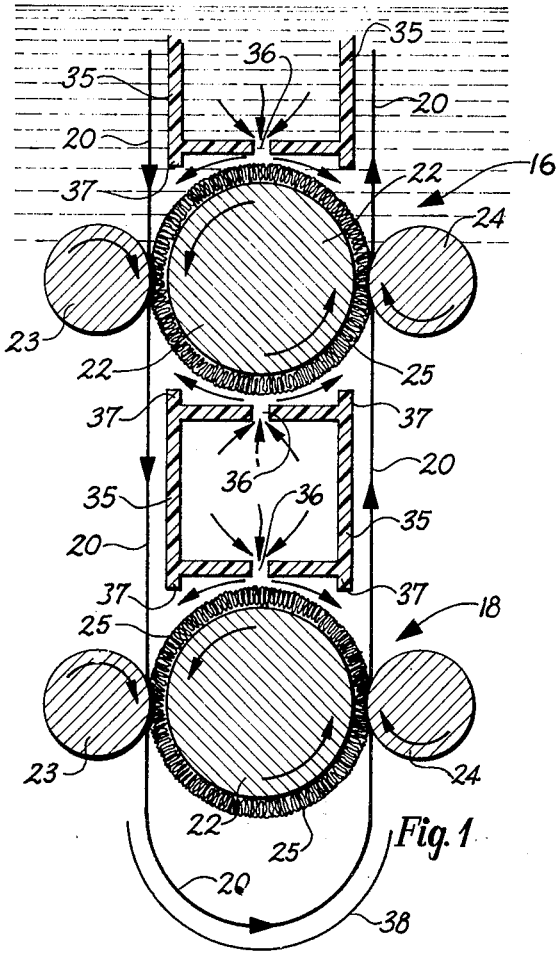
FIG. 1 is a fragmentary vertical section of two sets of rollers, each illustrating the transport means of the present invention.

Now referring to FIG. 1, the stocking roller of the present invention is illustrated by two separate roller sets, generally identified by reference numerals 16 and 18. Each set includes a larger stocking covered roller 22 with a pair of smaller companion rollers 23 and 24, one on each side. While only two sets are shown, any number may be used depending upon the time interval that the film is to be exposed in any particular chemical solution. For example, in the fixing tank there might be half as many rollers as in the developing tank. The film strip 20 passes the stocking roller 22 on its left side, traveling downward, and returns traveling upward on the right side of the stocking roller, as indicated by the arrows. Each stocking roller 22 has a pair of smaller companion rollers 23 and 24 located on opposite sides thereof which press the film 20 against the stocking covering 25. In the absence of the film each smooth surfaced companion roller 23 and 24 partially compresses the fabric or nap of the stocking covering 25. The axis of rotation of the stocking roller 22 and the companion rollers are fixed with respect to each other, leaving the tolerance between the rollers to the resilient stocking 25. This added tolerance maintains an even pressure across the rollers at all times.

Figure 2:
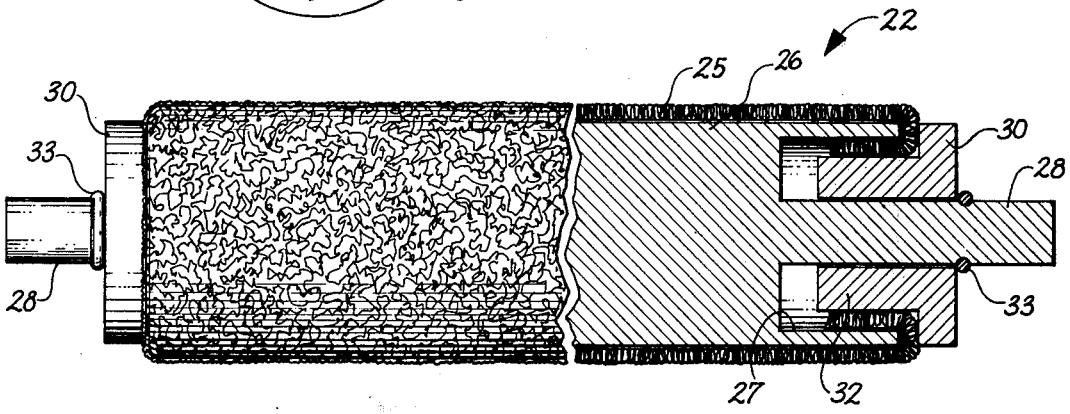
FIG. 2 is a side view of the fabric covered rollers with portions broken away and shown in longitudinal section.

Each roller 22, as seen in FIG. 2, has a hard surface core 26 with concentric cavities 27 in each end. The rollers can be made of various plastics and metals that will not react with the chemical solutions utilized. Extending from each cavity 27 is a journal 28 for rotatably supporting the roller 22. The stocking 25 is a seamless woven or knitted material having a tubular shape. The stocking 25 is mounted on the roller by the insertion of plugs 30 over the journal ends 28 of the roller. The inner end 32 of the plug 30, pinches the end of the stocking 25 into the cavity 27, stretching the stocking taut on the roller 26. Snap ring 33 releasably holds plug 30 in place.

The stocking material 25, can be any natural or synthetic fiber which is not affected by the chemical solutions it is in contact with. Woven cotton and wool with a looped nap have worked very well. The nap can also be cut. A sheared natural wool fleece bonded to the rollers with an adhesive can also be used. Any type of fibrous weave or knit which is open so that a low velocity fluid flow will easily wash out the collected exhausted chemicals can be used. Cellular plastic foams are not usable since they have a tendency to retain the exhausted chemicals and also there is not the vigorous agitation action that is achieved with a resilient fiber.

Positioned between each set of rollers 16 and 18 is a distribution chamber 35 which dispenses the fresh solutions of chemistry on the stocking roller 22. At a very low velocity, the fresh solution flows out the longitudinal slots 36, bathing a substantial portion of the stocking roller 22 between contact points with the film. The various film guide members are not shown in the drawing for pusposes of simplicity, since they are not part of the invention and are well known in the art.

OPERATION

All of the sets of rollers 16 in the processor are driven by a positive drive at a constant speed. This includes the smooth surfaced companion rollers 23 and 24. The film strips or sheets 20 are introduced into the processor with the emulsion side of the film facing the stocking roller 22. An initial means for advancing and guiding the film 20 to the first set of rollers 16 is not shown since it is not a part of the present invention. As the film 20 comes between rollers 23 and 22, the fibrous covering is caused to partially compress against the emulsion surface, thereby effecting a scrubbing action by the displaced fibers. This action not only agitates the exhausted chemicals on the emulsion, but also entraps these chemicals in the stocking 25, carrying it through the area of contact with the film 20 and the companion roller 23. As the film travels from the first to the second set of rollers, it is exposed to a flow of fresh chemical solutions flowing from slots 36 around the edge 37 of the distribution chamber as indicated by the arrows in FIG. 1. When the film 20 passes between the bottom set of rollers 23 and 22, it is guided by some form of guide 38 back up the opposite side of the stocking rollers 22 in contact with companion rollers 24. While not illustrated in the drawing, the stocking covering could be on the companion rollers 23 and 24 with the center roller 22 smooth surfaced. With this configuration, the emulsion side of the film would be reversed. The stocking can also be used on both center roller and companion rollers.

The flow of fresh solution flowing through slots 36 contacts and passes through the stocking material 25 washing out the exhausted chemicals collected from the emulsion. When there is no film passing through the rollers, flow of fresh solution against the stocking and the compression of the stocking by its companion rollers causes the stocking roller to thoroughly clean and rinse itself. Also, the action of the scrubbing fibers on the companion rollers 23 and 24 keeps them free of any build up.

Having described the invention with sufficient clarity to enable those familiar with the art to construct and use it, I claim:

1. An apparatus for transporting photographic film in a chemical solution comprising a pair of parallel spaced rollers in contacting relation, at least one of said rollers including a cylindrical member having concentric circular cavities in each end thereof, a plug means for insertion into each of said end cavities and having circular portions with a diameter less than the diameter of said end cavities, and a tubular-shaped stocking member surrounding said cylindrical member with its free ends releasably held in said end cavities by said plug means and said rollers being rigidly positioned such that said stocking covered roller is depressed along its line of contact with its companion roller to cause a scrubbing action to take place on said film passing between said rollers.

* * * * *